United States Patent [19]

Huang

[11] Patent Number: 4,889,264

[45] Date of Patent: Dec. 26, 1989

[54] SHIRT FOLDING MACHINE

[76] Inventor: Mekking Huang, No. 5, Lane 61, Ping Ho Road, Chung Ho, Taiwan

[21] Appl. No.: 247,158

[22] Filed: Sep. 21, 1988

[51] Int. Cl.[4] ..... D06F 89/02

[52] U.S. Cl. ..... 223/37

[58] Field of Search ..... 223/37, 38

[56] References Cited

U.S. PATENT DOCUMENTS

| | | | |
|---|---|---|---|
| 2,010,333 | 8/1935 | Steele | 223/37 |
| 2,310,555 | 2/1943 | Steele | 223/37 X |
| 2,367,261 | 1/1945 | Bicknell et al. | 223/37 |
| 2,639,065 | 5/1953 | Forse et al. | 223/37 |
| 2,727,660 | 12/1955 | Neckel | 223/37 |
| 4,277,005 | 7/1981 | Heap | 223/37 |

*Primary Examiner*—Werner H. Schroeder

*Attorney, Agent, or Firm*—Balogh, Osann, Kramer, Dvorak, Genova and Traub

[57] ABSTRACT

A shirt folding machine, comprising stroke adjustable neck opening fixation plates, revolvable shirt folding mold board, and ironing board; the shirt to be folded being slipped on the neck opening fixation plates that are arranged to relatively close to each other, by means of the separation of said neck opening fixation plates the neck opening of the shirt to be folded being fully stretched; by means of the clamping effect of the shirt folding board and the ironing board the shirt to be folded being firmly clamped therebetween for ironing process; by means of the support of the shirt folding mold board, the protruding portion of the shirt clamp being well folded, in accordance with the configuration of the shirt folding mold board, into preferred rectangular arrangement for distribution on the market.

6 Claims, 5 Drawing Sheets

SHIRT FOLDING MACHINE

BACKGROUND OF THE INVENTION

The invention relates to a folding machine for the shirts of regular notched collar or for leisure shirts, and more particularly a machine to fold the shirts of all neck openings into a fixed configuration.

Regularly, the shirts must be folded and packed in a fixed rectangular configuration prior to offering for sale, so as to provide a neat, outstanding and eminent appearance to attract consumers to buy.

Currently, there are some shirt folding machines available on the market. However, the conventional shirt folding machines that are commonly used are of fixed type applicable for single size. While folding the shirts of different sizes in neck opening, it requires to change the neck opening fixation part. Therefore, the conventional shirt folding machine is not convenient to use and requires longer processing time and several sets of different sizes of neck opening fixation parts, and further, the processing cost is high.

In view of said disadvantages existed in conventional shirt folding machines, there is a strong demand for a folding machine applicable for use to fold the shirts of all neck openings.

SUMMARY OF THE INVENTION

The invention relates to a shirt folding machine to fold the shirts of regular notched collar or leisure shirts into a fixed configuration, which comprises stroke adjustable neck opening fixation plates, revolvable shirt folding mold board, and ironing board. The shirt to be folded is mounted on the neck opening fixation plates by slip joint, while the neck opening fixation plates are arranged to relatively close to each other, by means of the separation of said neck opening fixation plates the neck opening of the shirt to be folded is fully stretched; by means of the clamping effect of the shirt folding board and the ironing board the shirt to be folded is firmly clamped therebetween for ironing process; by means of the support of the shirt folding mold board, the protruding portion of the shirt is well folded, in accordance with the configuration of the shirt folding mold board, into preferred rectangular arrangement for distribution on the market.

Said shirt folding machine further comprises two cylindrical driving mechanisms and respective pedal switches. The operator controls said two pedal switches by foot to respectively drive neck opening fixation plates, shirt folding mold board and ironing board to proceed with the folding process.

The stroke adjusting device for adjusting the stoke of the neck opening fixation plates comprises a screw and one set of symmetrical check blocks that are mounted on the screw by means of screw joint. Said check blocks are arranged to respectively stop the far apart neck opening fixation plates at proper locations. Therefore, the relative stroke of the neck opening fixation plates can be adjusted by means of turning the screw to change the distance between said two check blocks, i.e. the neck opening fixation plates can be adjusted to stretch the neck openings of all sizes.

BRIEF DESCRIPTION OF THE DRAWINGS

The invention as well as its many advantages may be further understood by reference to the following detailed description and drawings in which.

DETAILED DESCRIPTION OF THE PREFERRED EMBODIMENT

Figure 1:
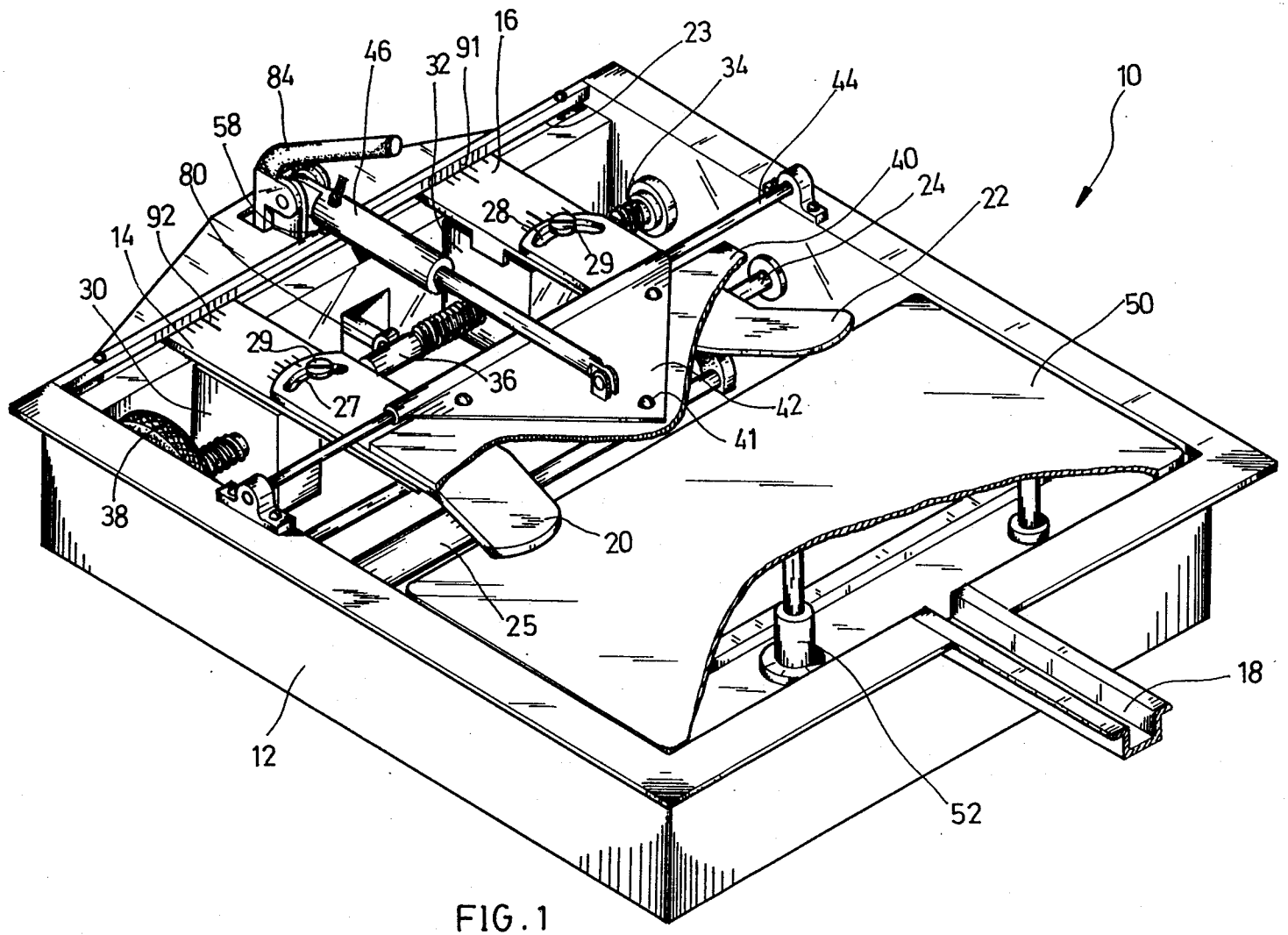
FIG. 1 is a perspective view of a folding machine embodying the invention, wherein the central portion is illustrated in a sectional view.
Figure 2:
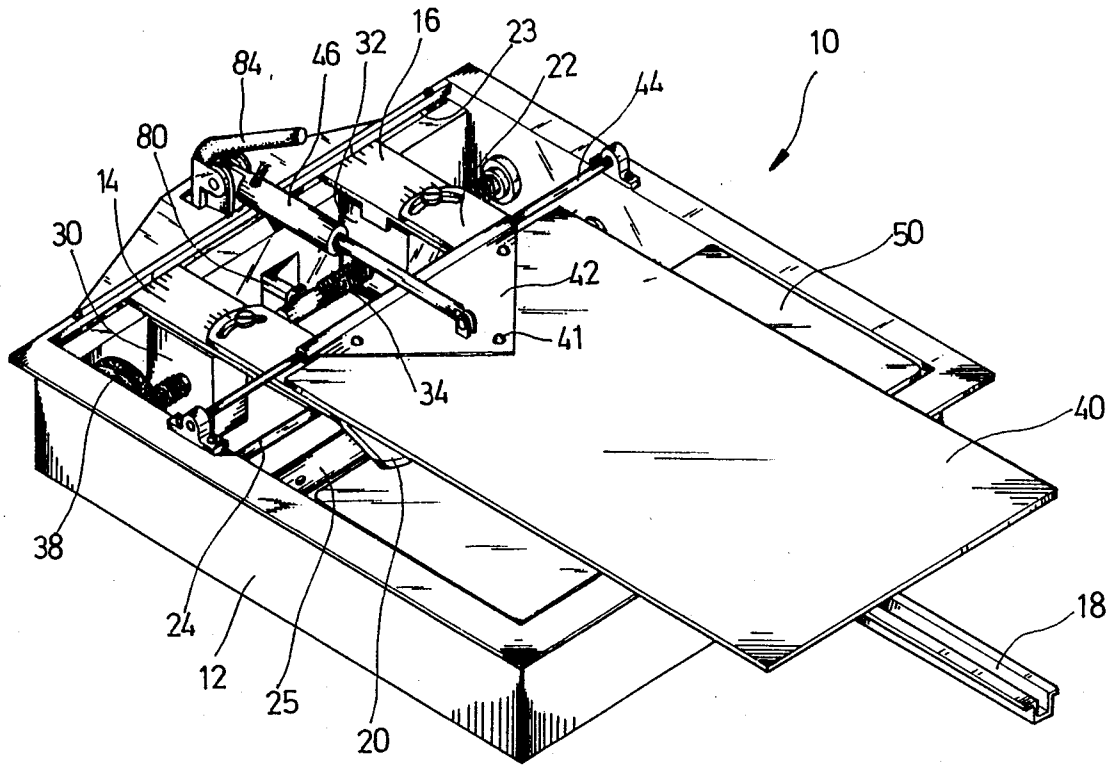
FIG. 2 is another perspective view of the embodiment according to FIG. 1.
Figure 3:
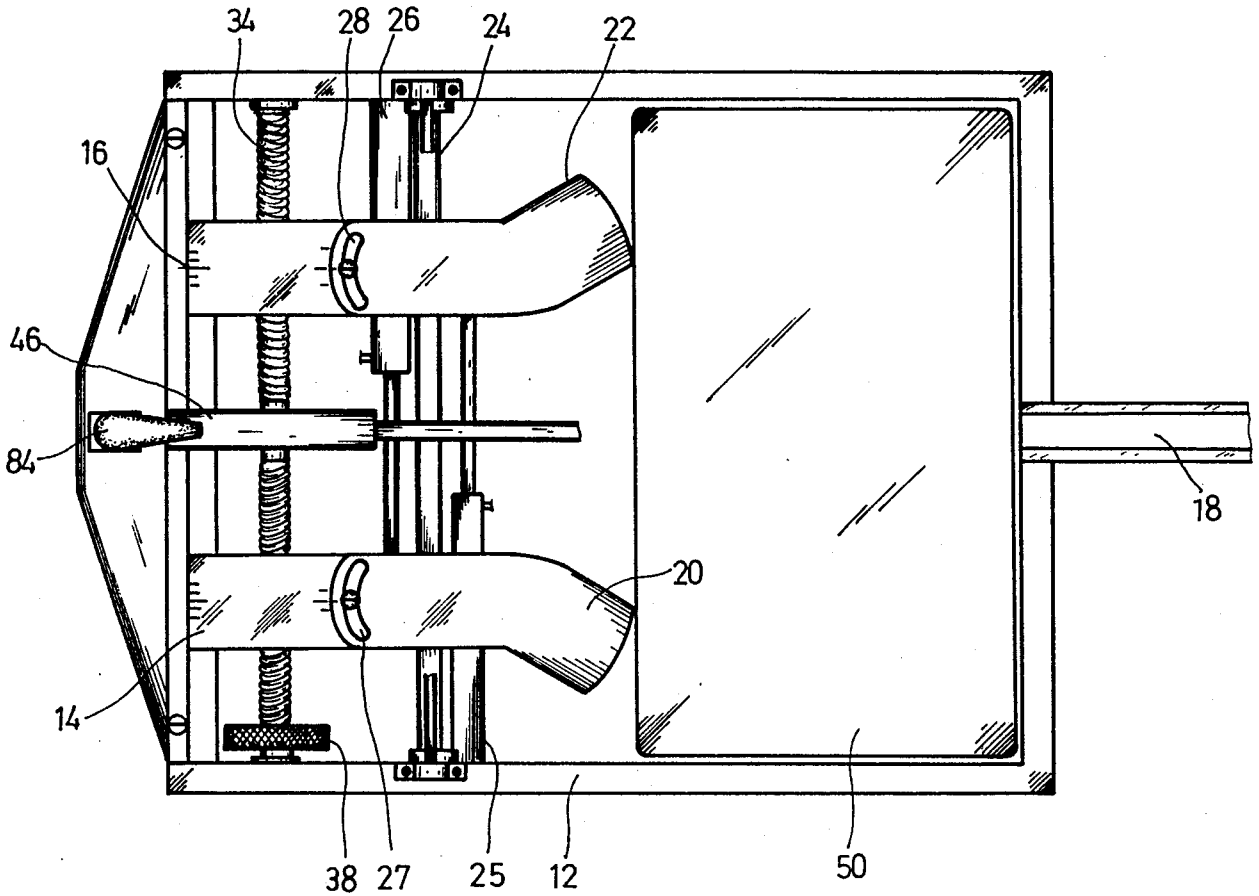
FIG. 3 is a top view of the embodiment taken in FIG. 2, wherein the folding plate and the driving cylinder are not shown.
Figure 4:
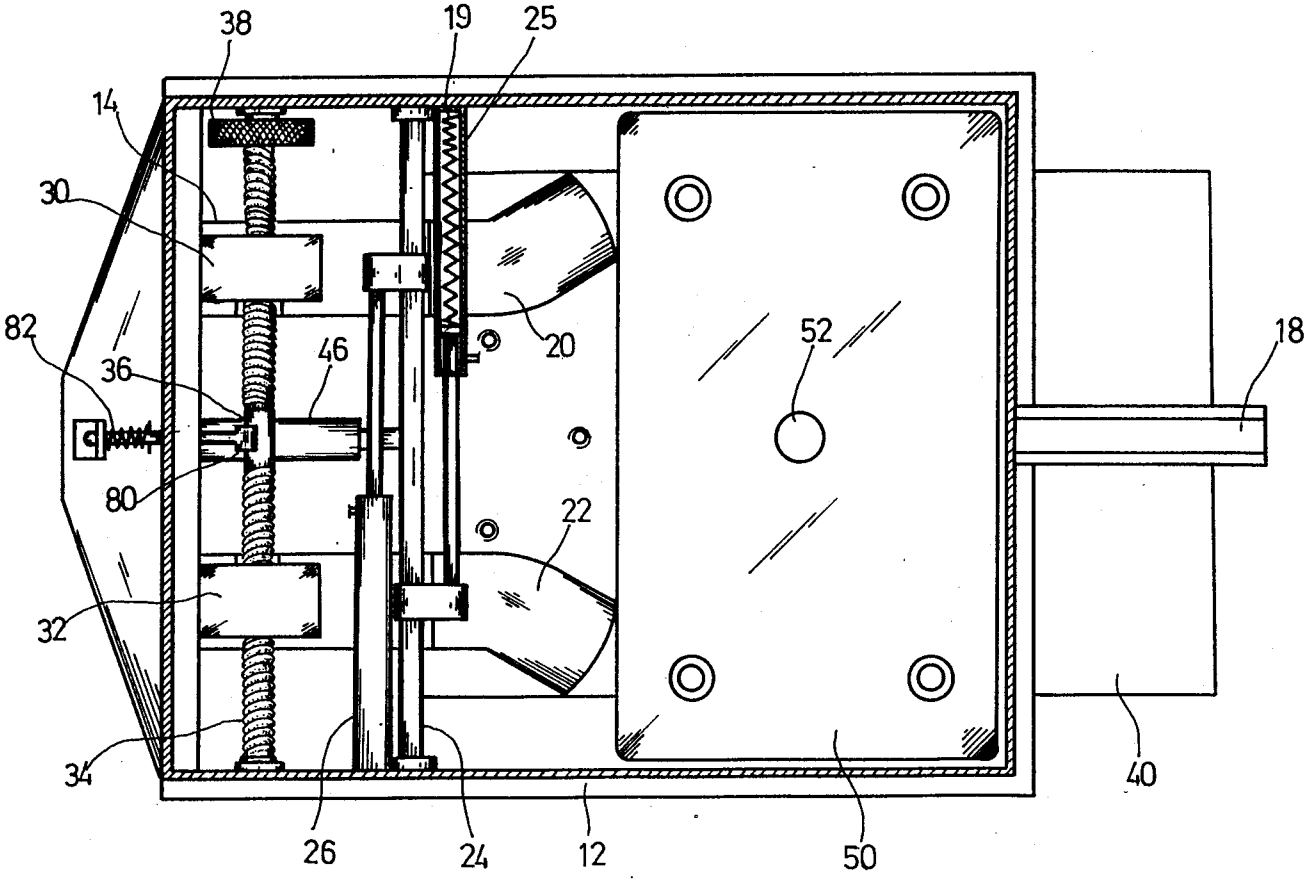
FIG. 4 is a bottom view of the embodiment taken in FIG. 3, wherein the housing is illustrated in a sectional view.

Please refer to the drawings above described. The folding machine 10 according to the invention, is to help the operator to fold the clothes into a fixed shape, which is applicable for folding the clothes of all sizes in neck opening.

The folding machine 10 comprises a housing 12, two neck opening fixation plates 20 22 arranged bilaterally to make relative movement, two check blocks 30 32 and the related screw 34 for adjusting the stroke of said neck opening fixation plates 20 22, a pivotally movable shirt folding mold board 40 mounted on the housing 12, an elevating ironing board 50 arranged below said folding plate 40, a power cylinder and its pedal switch to respectively drive all moving members.

Figure 5:
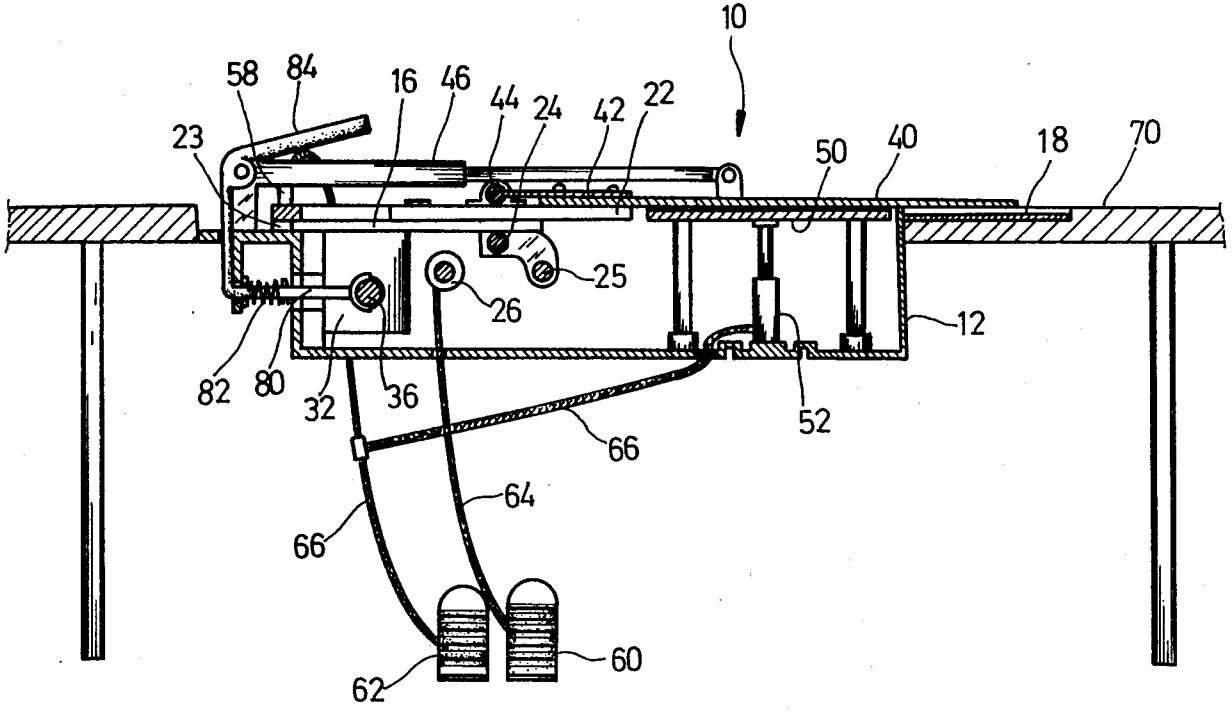
FIG. 5 is a longitudinal sectional view of the embodiment above described, wherein the embodiment is arranged on a table.

Referring to FIG. 5, the housing 12 is set in the upper surface 70 of a table and firmly fixed therein such that the operator can conveniently use the folding machine 10 above the face 70 of the table, to fold the shirts into a fixed shape; said housing 12 is to contain and support all the component parts of the folding machine 10.

Said neck opening fixation plates 20 22 are respectively arranged at two symmetric positions bilaterally in the housing 12 to relatively slide along the mandrel 24 and the guide way 23 in transverse direction; two symmetric and single acting cylinders, first cylinder and second cylinder 25 26 are arranged to act simultaneously to drive said neck opening fixation plates 20 22 to respectively make reciprocal movement in transverse direction; two symmetric check blocks 30 32 are arranged to respectively confine the stroke of the neck opening fixation plates 20 22. Regularly, when compressed air is not available in the first and the second cylinders 25 26, the neck opening fixation plates 20 22 are pushed outward by respective springs (not shown in the drawing) arranged in the cylinders 25, 26, to contact and be stopped by the respective check blocks 30 32 at pre-fixed positions. Before setting the shirt to be folded over the neck opening fixation plates, the operator must step on the first pedal switch 60 to let the compressed air run through air hose 64 into first and second cylinders 25 26, because the pressure of the compressed air overpasses the spring force of the springs of respective cylinders, therefore, the neck opening fixation plates 20 22 are driven inward to return to the central position; at this moment, the distance between said two neck opening fixation plates 20 22 is minimized to allow the operator to conveniently arrange the shirt to be folded letting the neck opening slip over the neck opening fixation plates 20 22; then, the first pedal switch 60 is released and the compressed air is stopped from entering the first and the second cylinders 25 26, the neck opening fixation plates 20 22 are thus pushed outward by means of spring force and stopped by respective check blocks, to stretch the neck opening of the shirt.

The front end of each said neck opening fixation plate 20 22 is arranged in a curved shape to match with the neck opening, and the rear end of each said neck opening fixation plate is arranged to provide a curved slot 27 28; by means of a bolt 29 through the curved slot 27 28, each neck opening fixation plate 20 22 is tightly screwed up with respective matching plate 14 16, such that the contained angle between the matching plate and the neck opening fixation plate is adjustable to fit all styles of neck openings.

The check blocks 30 32 which are arranged to confine the stroke of the neck opening fixation plates 20 22 are threaded by a screw 34 and arranged at both ends of the screw 34, the central part of the screw 34 is a smooth portion 36, and the bilateral threads have a same pitch and are arranged in reverse direction, therefore, when the operator turns the revolving button 38 which is tightly mounted on the screw 34, the check blocks 30 32 will be driven to move relatively, and the distance between the check blocks 30 32 will be adjusted accordingly; When the distance between said two check blocks 30 32 is adjusted, the stroke of the two neck opening fixation plates will be changed accordingly to fit the shirts of all styles of neck openings.

A braking device 80 is arranged to provide a braking force on the smooth portion 36 of the screw 34 by means of the push of the spring 82, to prevent the screw 34 from turning around to cause displacement of the check blocks 30 32 due to impact force from neck opening fixation plates. As afore described, before turning the revolving button 38, the operator must press down the crank 84 of the braking device 80 to let the braking device 80 break away from the screw 34, so as to let the screw 34 be freely turned round.

For easy operation in folding process, in addition to the stroke adjustable neck opening fixation plates 20 22 to stretch the neck opening of the shirt to be folded, the folding machine 10 is arranged to provide a pivotally movable shirt folding mold board 40 to let the operator fold the shirt by means of the configuration of the plate 40. In order not to interfere with the procedure to slip the neck opening of the shirt over the neck opening fixation plates, the shirt folding mold board 40 is designed to be liftable, which is closed up during folding process. The shirt folding mold board 40 which is replaceable is fixedly attached to a triangular plate 42 by means of screws 41; said triangular plate 42 is connected with a transverse mandrel 44 by means of slip joint; a third single action cylinder 46 is arranged to control the lifting or closing of the shirt folding mold board 40; said third single action cylinder 46 is movably connected with the housing 12 and the triangular plate 42 respectively at both ends for pivotal movement. When compressed air is introduced into the third cylinder 46, the shirt folding mold board 40 is forced to close up at the top of the housing 12; when there is no compressed air available in the third cylinder 46, the shirt folding mold board 40 can either be lifted or be easily and simply closed up at the operator's own will, by applying little force.

Said shirt folding mold board 40 is designed according to the style of the shirt to be folded, or the folded style and size preferred; more particularly, the shirt folding mold board 40 is replaceable when necessary.

Said elevating ironing board 50 which is arranged below the shirt folding mold board 40 is controlled by the fourth cylinder 52 to make longitudinal movement; at regular time, the compressed air does not enter the fourth cylinder 52, and the ironing board drops to a lower position due to gravity; when compressed air enters the fourth cylinder 52, the piston rod of the fourth cylinder 52 will immediately lift the ironing board 50 to a higher position adjacent to the closed up shirt folding mold board 40.

When to start folding process by using the present folding machine, the operator should button up the shirts to be folded in advance, and then, follow the following procedures to proceed with folding process: (a) open the shirt folding mold board 40, and step on the first pedal switch 60 to let the neck opening fixation plates 20 22 be pulled back inward, so as to let the neck opening of the shirt to be folded be arranged on the neck opening fixation plates by slip joint with the front of the shirt facing downward; (b) make sure that all the buttons of the shirt to be folded are arranged inside the button channel 18 at the central line of the housing 12; (c) close up the shirt folding mold board 40 by hands, and release the first pedal switch 60 to let the two neck opening fixation plates 20 22 move outward respectively to properly stretch the neck opening of the shirt to be folded; (d) step on the second pedal switch 62 to concomitantly introduce outside compressed air through the air hose 66 into the third and the fourth cylinders 46 52, so as to let the shirt be sandwiched by the folding mold board 40 and the ironing board 50 for ironing treatment on the front of the shirt; (e) continuously step on the second pedal switch 62, use the hands to stretch the protruding portion of the shirt beyond the shirt folding mold board 40, and start to fold the protruding portion of the shirt according to the configuration of the mold board 40, to let the shirt be folded into preferred arrangement, the well folded shirt may be fixed by pin and be supported by paper board to let the folded style be well maintained; and (f) release the second pedal switch 62 and step on the first pedal switch 60 again, so as to lift the shirt folding mold board 40 and remove the well folded and ironed shirt.

While proceeding with above said procedure (a), the operator shall have to reach out the hands between the shirt folding mold board 40 and the lower ironing board 50 to lift the mold board 40, at this moment, if the operator or someone else steps on the second pedal switch 62 unintentionally, the hands of the operator may be clamped by the mold board 40 and the ironing board 50 to cause accident; therefore, a microswitch 58 is provided to prevent any accident, when the shirt folding mold board 40 is lifted, the microswitch is triggered simultaneously to cut off the power for the second pedal switch 62, such that the second pedal switch 62 is temporarily out of work, and accident can be prevented.

The movable neck opening fixation plates 20 22 and the related portion of the standing housing 12 are arranged to provide linear measure graduation and scale mark 91 92 for identification of the stroke of the neck opening fixation plates or the applicable size of neck opening.

Either a skilled operator or a beginner can easily learn to use the present folding machine to help shirt folding and to improve the productivity. When necessary, the stroke of the neck opening fixation plates can be adjusted in a simple and efficient way, to match with different size of neck openings of the shirts to be folded. While adjusting the stroke of the neck opening fixation plates, there is no need to remove any parts of the machine.

In addition to the above described advantages, the present folding machine 10 has a simple structure, of which the manufacturing cost is inexpensive.

As indicated, the structure herein may be variously embodied. Recognizing various modifications will be apparent, the scope hereof shall be deemed to be defined by the claims as se forth below.

What is claimed is:

1. A shirt folding machine, comprising:

an inside recessing housing;

two neck opening fixation plates symmetrically arranged at the two lateral sides of said housing, to stretch the neck opening of the shirt to be folded;

a driving mechanism being controlled to drive said neck opening fixation plates to relatively make reciprocal movement;

an adjusting device for adjusting the stroke of said two neck opening fixation plates;

a shirt folding mold board arranged in a configuration and size according to the shirt to be folded, movably mounted on the top of said housing for pivotal movement;

a driving mechanism being controlled to drive said shirt folding mold board to close up at the top of said housing; and an ironing board arranged below said shirt folding mold board to match with said shirt folding mold board to clamp the shirt to be folded.

2. A shirt folding machine according to claim 1, wherein said adjusting device for adjusting the stroke of said two neck opening fixation plates comprises a screw and two check blocks to confine the stroke of said two neck opening fixation plates; said screw comprising bilaterally a thread of same pitch in reverse direction, said two check blocks being symmetrically mounted on the screw by screw joint.

3. A shirt folding machine according to claim 2, wherein a releasable braking mechanism is provided to brake said screw.

4. A shirt folding machine according to claim 1, wherein a microswitch is provided to stop the mold board driving mechanism at the time the shirt folding mold board is lifted.

5. A shirt folding machine according to claim 1, wherein an adjusting device is provided to adjust the contained angle between the neck opening fixation plates and the housing.

6. A shirt folding machine according to claim 1, wherein the housing is arranged to provide linear measure graduation for indicating the stroke of the neck opening fixation plates.

* * * * *